US008382091B2

(12) United States Patent
Yoda et al.

(10) Patent No.: US 8,382,091 B2
(45) Date of Patent: Feb. 26, 2013

(54) RECORDING APPARATUS

(75) Inventors: Hiroyuki Yoda, Nagano-ken (JP); Takehiko Saito, Nagano-ken (JP); Sanshiro Takeshita, Nagano-ken (JP); Hidenao Suzuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/360,943

(22) Filed: Jan. 30, 2012

(65) Prior Publication Data

US 2012/0193864 A1 Aug. 2, 2012

(30) Foreign Application Priority Data

Jan. 31, 2011 (JP) ..... 2011-017946

(51) Int. Cl.
*B65H 5/22* (2006.01)
*B65H 83/00* (2006.01)
*B65H 85/00* (2006.01)
*B65H 1/00* (2006.01)

(52) U.S. Cl. ..... 271/3.14; 271/4.01; 271/145; 271/162

(58) Field of Classification Search ..... 271/3.14, 271/4.01, 145, 162, 163
See application file for complete search history.

(56) References Cited

U.S. PATENT DOCUMENTS

| | | | | |
|---|---|---|---|---|
| 4,854,757 | A * | 8/1989 | Kikuchi | 400/605 |
| 6,371,476 | B2 * | 4/2002 | Isogai et al. | 271/3.14 |
| 6,848,850 | B2 | 2/2005 | Matsuo et al. | |
| 7,466,435 | B2 * | 12/2008 | Silverbrook et al. | 358/1.1 |
| 7,619,756 | B2 * | 11/2009 | Silverbrook et al. | 358/1.1 |
| 7,864,345 | B2 * | 1/2011 | Silverbrook et al. | 358/1.1 |
| 2012/0086164 | A1 * | 4/2012 | Kondo et al. | 271/149 |
| 2012/0193864 | A1 * | 8/2012 | Yoda et al. | 271/145 |

FOREIGN PATENT DOCUMENTS

| | | |
|---|---|---|
| JP | 2003-127484 | 5/2003 |
| JP | 2010-235311 | 10/2010 |

* cited by examiner

*Primary Examiner* — David H Bollinger

(57) ABSTRACT

A recording apparatus includes a recording section that performs recording on a recording medium, a housing that stores the recording section, a recording medium cassette that is detachably mounted on the housing and has a cassette body that holds the recording medium in the vertical position, and a holder that holds the recording medium that has been fed from the cassette body and has been recorded in the recording section on the outer surface of the cassette body in the vertical position.

7 Claims, 7 Drawing Sheets

RECORDING APPARATUS

BACKGROUND

1. Technical Field

The present invention relates to recording apparatuses including a recording medium cassette that is detachably mounted and stores recording media in the vertical position so that desired recording is performed on the recording medium that has been fed from the recording medium cassette.

2. Related Art

JP-A-2003-127484 discloses a paper output section that is mounted on a vertical type recording apparatus that performs recording on a recording medium and holds the recording medium (recording paper) in the vertical position after recording is performed on the recording medium that has been fed from a sheet feeding section that stores recording medium in the vertical position. The paper output section is fixedly provided in the recording apparatus separately from the sheet feeding section at a different position.

Further, JP-A-2010-235311 discloses a recording medium cassette (sheet feeding cassette) that is detachably mounted on a horizontal type recording apparatus and includes a cassette body (main tray) that is capable of storing recording media (recording papers) and a paper output tray that is stacked on the cassette body and holds recording media after recording is performed.

The paper output section of the vertical type recording apparatus as disclosed in JP-A-2003-127484 has a problem in that the recording medium stored in the paper output section after recording is difficult to be removed by a user when the height of the recording medium is smaller than that of the paper output section.

In the recording medium cassette of the horizontal type recording apparatus as disclosed in JP-A-2010-235311, the output recording medium is placed on the paper output tray. Accordingly, the recording medium after recording is performed can be removed by removing the recording medium cassette, even if the recording medium has small size. However, if the recording medium cassette for the horizontal type recording apparatus is applied to the vertical type recording apparatus, the output recording medium may lean, since the output recording medium cannot be held in the vertical position. In this case, the subsequent recording media to be output cannot be appropriately delivered to the holding position. Further, if the recording medium cassette is removed from the recording apparatus with the recording medium leaning, the recording medium may be damaged after recording is performed. Therefore, it is not possible to apply such a recording medium cassette to the vertical type recording apparatus.

SUMMARY

An advantage of some aspects of the invention is that a recording apparatus including a recording medium cassette that is capable of feeding out the recording medium stored in the vertical position, holding the recording medium in the vertical position after recording being performed and removing the recording medium with ease is provided.

According to an aspect of the invention, a recording apparatus includes a recording section that performs recording on a recording medium, a housing that stores the recording section, a recording medium cassette that is detachably mounted on the housing and has a cassette body that holds the recording medium in the vertical position, and a holder that holds the recording medium that has been fed from the cassette body and has been recorded in the recording section on the outer surface of the cassette body in the vertical position.

With this configuration, the recording medium that has been output on the outer surface of the cassette body is held by the holder while being kept in the vertical position. Accordingly, since the recording media are sequentially stacked in the holder without leaning in an appropriate manner, the recording media can be continuously output. Further, it is possible to prevent the recording medium after recording being performed from being damaged when the recording medium cassette is removed from the recording apparatus.

It is preferable that the outer surface of the cassette body has a receiving section that receives the lower end of the recording medium that has been recorded in the recording section.

Further, it is preferable that the recording medium includes a paper output roller that outputs the recording medium toward the outer surface of the cassette body between the holder and the receiving section.

Further, it is preferable that the holder has a plate member that faces the outer surface with a gap interposed therebetween.

With this configuration, the recording medium after recording being performed can be supported on an area having long length in the width direction (a direction perpendicular to a feeding direction), thereby securely holding the recording medium.

Further, it is preferable that the holder serves as a side alignment guide for the recording medium that has been output.

With this configuration, the width of the holder can be adjusted for the width (length in the direction perpendicular to the feeding direction) of the recording medium that has been recorded and output. Accordingly, the recording medium can be appropriately held regardless of the size of the recording medium.

Further, it is preferable that the holder is formed integral with an edge guide that guides the edge of the recording medium stored in the cassette body.

Further, it is preferable that the holder extends from the cassette body in the feeding direction of the recording medium.

With this configuration, since the holder extends in the feeding direction, the recording medium can be appropriately held even if the recording medium extends longer in the feeding direction.

Further, it is preferable that the holder has an opening through which the recording medium held by the holder is viewable from the outside.

With this configuration, the output recording medium can be easily viewed from the outside. Accordingly, it is possible to prevent the recording medium from being left.

According to the above aspect of the invention, the recording medium cassette includes a cassette body that is detachably mounted on the recording apparatus that performs recording on the recording medium and holds the recording medium in the vertical position and that is configured such that a surface of the cassette body serves as a holding surface for the recording medium that has been fed from the stored state and has been recorded, and a holder that is disposed on the holding surface of the cassette body and supports the recording medium in the vertical position.

With this configuration, the recording medium that has been output on the holding surface is held (stocked) by the holder while being kept in the vertical position. Accordingly, since the recording media are sequentially stacked on the holding surface without leaning in an appropriate manner, the recording media can be continuously output. Further, it is possible to prevent the recording medium after recording being performed from being damaged when the recording medium cassette is removed from the recording apparatus. Moreover, when the recording medium cassette is removed from the recording apparatus, supplying of unrecorded recording medium and removing of recorded recording medium can be achieved at the same time. This facilitates removing of recorded recording medium, even if the recording medium is small and removing of recorded recording medium with the recording medium cassette being mounted on the recording apparatus is difficult. Further, since a portion (a side) of the cassette body serves as the holding surface that supports the recording medium, a separate configuration to hold the recording medium can be eliminated, thereby simplifying the configuration and reducing the cost.

In this configuration, it is desirable that the holder has a plate member that faces the holding surface with a gap interposed therebetween.

Further, it is desirable that the plate member of the holder is formed to transverse the holding surface in the direction perpendicular to the feeding direction of the recording medium.

With this configuration, the recording medium after recording being performed can be supported on an area having long length in the width direction (the direction perpendicular to the feeding direction), thereby securely holding the recording medium.

In addition, it is desirable that the plate member of the holder faces the output recording medium at one end in the direction perpendicular to the feeding direction of the recording medium.

With this configuration, the recording medium after recording being performed can be held on a small contact area. This reduces the possibility of damage on the recording surface of the recording medium due to contact between the plate member and the recording surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
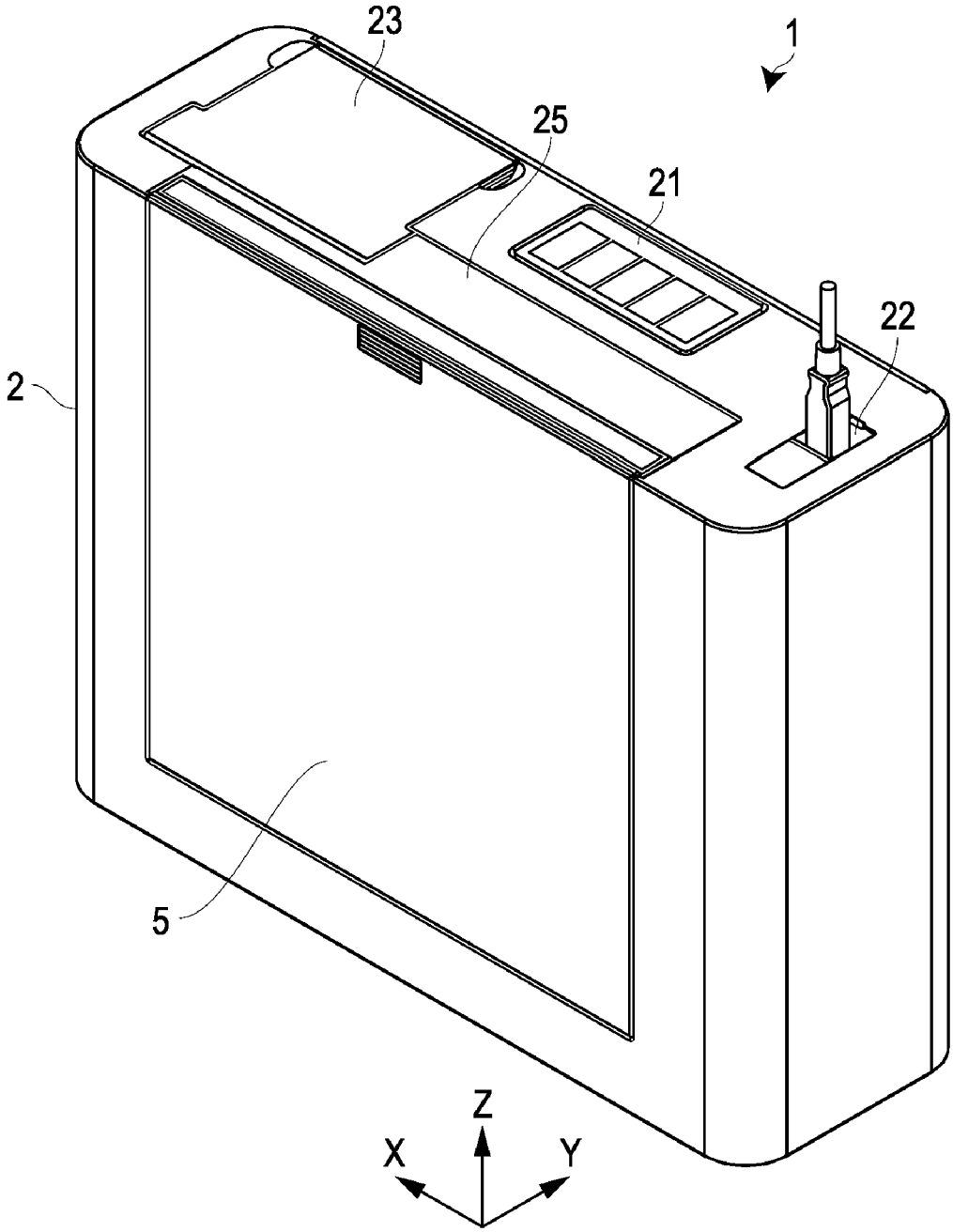
FIG. 1 is an external perspective view of a recording apparatus.

A recording apparatus including a recording medium cassette according to a first embodiment of the invention will be described below with reference to the accompanying drawings. The recording apparatus is configured to hold paper sheets (recording media) in the vertical position, perform desired recording on the paper sheets while being transported, and hold (stock) the output paper sheets in the vertical position after recording being performed. In the following description, X, Y and Z axes in the drawings indicate the left-right, front-back and up-down directions, respectively.

Figure 2:
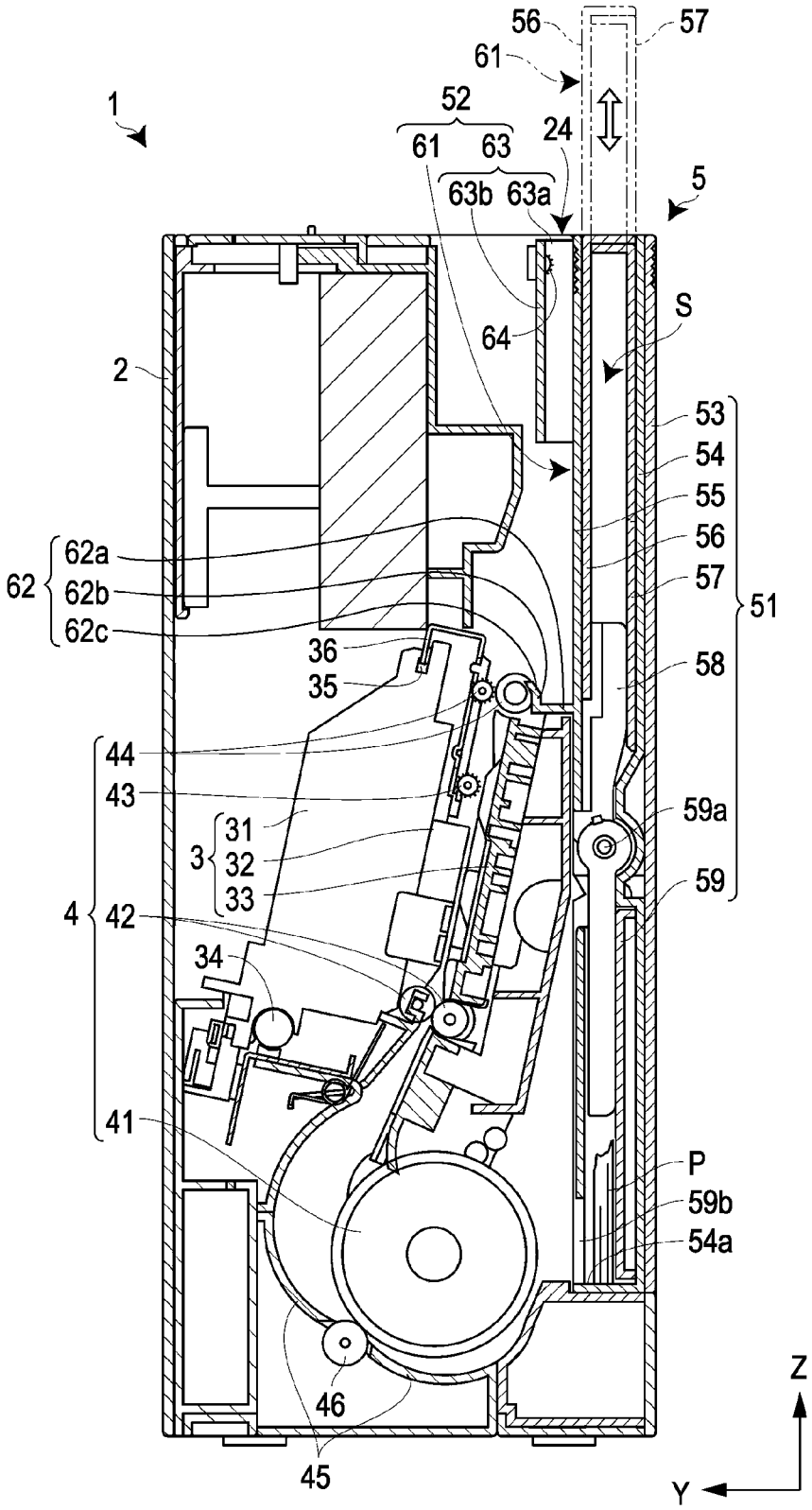
FIG. 2 is a side sectional view of the recording apparatus with a paper sheet placed away from a feeding roller.

As shown in FIG. 1 or 2, the outline of a recording apparatus 1 is formed by a housing 2 having a thin box-like shape whose length in the Z axis direction is longer than that of the X and Y axes direction. The recording apparatus 1 includes a printing section 3 which is a recording section that performs an ink-jet type printing operation on a paper sheet P that moves on a transportation path, a transportation section 4 that feeds flat paper sheets P along the transportation path, a recording medium cassette 5 that is detachably mounted on the housing 2 and stores the paper sheets P in the vertical position and an apparatus frame (not shown in the figure) that supports the transportation section 4, the printing section 3 and the like.

The top of the housing 2 is provided with an operation panel 21 on which operation buttons and the like are disposed, a cable terminal 22 to which cable for connecting with a PC or the like is connected, and a cartridge cover 23 that openably covers a cartridge mounting section (not shown in the figure) in which a plurality of ink cartridges (not shown in the figure) are detachably loaded. The top of the housing 2 is further provided with a paper sheet output port cover 25 that openably covers a paper sheet output port 24 through which the paper sheet P (recording medium) is output after recording being performed. Although the paper sheet output port cover 25 is opened and/or closed by a user, the paper sheet output port cover 25 is configured to be automatically opened through an open/close mechanism, which is not shown in the figure, even if recording is performed while the paper sheet output port cover 25 being closed.

The printing section 3 is downstream of a pair of transportation rollers 42, which is described later, and includes a carriage 31 on which an ink jet head 32 is mounted and a guiding member 33 which is disposed at a position opposite the ink jet head 32.

The carriage 31 is movable in a reciprocating manner by a motor, which is not shown in the figure, along a carriage guide shaft 34 that extends in the X axis direction. As shown in FIG. 2, since the carriage 31 is disposed at an angled orientation, a rotating force about the carriage guide shaft 34 is generated. The carriage 31 is held at a constant orientation by a carriage guiding plate 36 that extends in the X axis direction being put in a guided section 35 that is formed above the carriage 31.

The guiding member 33 forms part of the transportation path, and also defines a gap (work gap) between a recording surface of the paper sheet P and the ink jet head 32. Further, a recess is formed on the guiding member 33 at a position opposite the ink jet head 32 such that, when borderless printing is performed, ink that is ejected onto the area outside the edge of paper sheet P is received therein. In the recess, an ink absorbent (not shown in the figure) is provided so as to absorb ink. Further, a waste liquid tank (not shown in the figure) is provided under the guiding member 33 so as to store the waste ink therein.

Although this embodiment shows a so-called off carriage type of recording apparatus in which ink cartridges are provided independently from the carriage 31, a so-called on carriage type in which ink cartridges are loaded on the carriage 31 may be used. In addition, although this embodiment shows a so-called serial printer in which recording is performed while the carriage 31 moves in the X axis direction, a fixed type ink jet head 32 that covers the width of the paper sheet P may be used. Further, various recording types other than ink jet type may also be used.

The transportation section 4 includes a feeding roller 41 that is disposed at a position opposite the distal end of the recording medium cassette 5 which is loaded from the upstream position, and feeds the paper sheet P supplied from the recording medium cassette 5 to the downstream region, the pair of transportation rollers 42 that transports the paper sheet P to the printing section 3, a guiding roller 43 that prevents the paper sheet P from being uplifted from the guiding member 33 in the printing section 3 and a pair of paper output rollers 44 that outputs the paper sheet P from the printing section 3 after recording being performed. In addition, each of a plurality of feeding rollers 41, transportation rollers 42, guiding rollers 43 and paper output rollers 44 are arranged spaced apart from each other at appropriate distances in the width direction of the paper sheet P (X axis direction).

When rotated by a motor, which is not shown in the figure, the feeding roller 41 feeds the paper sheet P to the lower side while being in contact with the leading end of the paper sheet P. A guide member 45 is disposed at a position opposite the outer periphery of the feeding roller 41 and forms a substantially U-shaped transportation path around which the paper sheet P is turned. In addition, reference numeral 46 denotes a supplementary driven roller that supports the feeding roller 41 to feed the paper sheet P.

After being fed to the lower side, the paper sheet P is turned around while passing through between the feeding roller 41 and the guide member 45 and is fed upward to the pair of transportation rollers 42. The paper sheet P is nipped between the pair of transportation rollers 42 and is fed to the printing section 3. after recording being performed in the printing section 3, the paper sheet P is output to an output holding unit 52 (which is described later) of the recording medium cassette 5 via the guiding roller 43 and the pair of paper output rollers 44.

Figure 3:
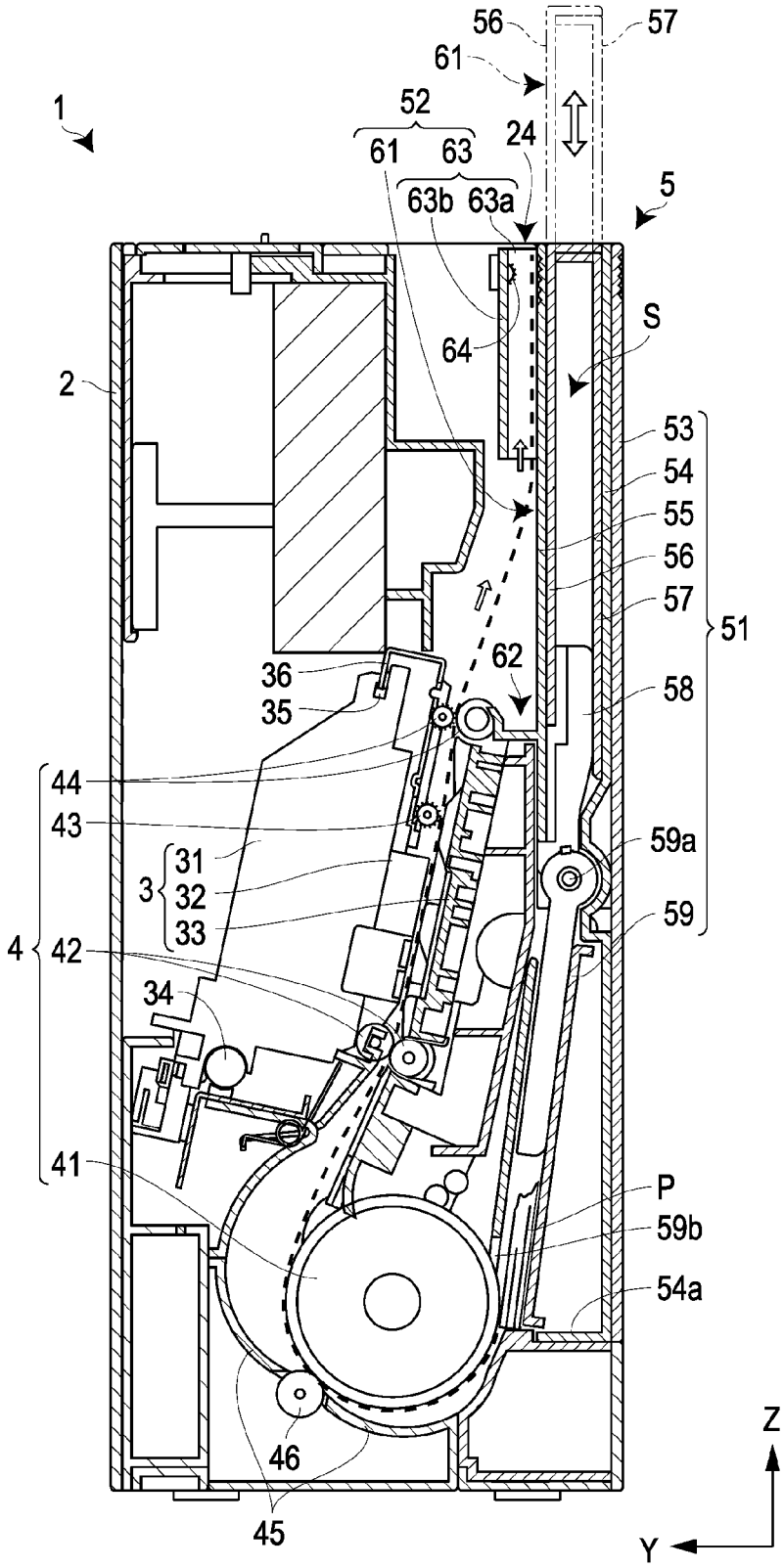
FIG. 3 is a side sectional view of the recording apparatus with a paper sheet being in contact with the feeding roller.

In this embodiment, the paper sheet P is output by the paper output rollers 44 in the obliquely upward direction as indicated by the broken line in FIG. 3, so that the paper sheet P is fed toward the recording medium cassette 5. The output paper sheet P moves upward while being in slidable contact with a holding surface 61 (which is described later) of the recording medium cassette 5.

Further, in this embodiment, the feeding roller 41 (and the supplementary driven roller 46), the transportation rollers 42 and the paper output rollers 44 are formed as nip rollers. Further, in this embodiment, each of the transportation roller 42 and the paper output roller 44 which are located on the side of the guiding member 33 are rotated by drive of a motor, which is not shown in the figure, such that each of the transportation roller 42, the guiding roller 43, and the paper output roller 44 which are located on the side of the ink jet head are moved in a driven manner. The drive roller of the paper output rollers 44 is formed by a rubber roller, while the guiding roller 43 and the paper output rollers 44 are formed by a spur-shaped roller (star wheel).

Next, referring to FIGS. 2 through 5, the recording medium cassette 5 will be described below in detail. The recording medium cassette 5 is detachably mounted on the housing 2 such that, when mounted, the recording medium cassette 5 constitutes the outline of the recording apparatus 1. Since the inside of the recording apparatus 1 is exposed when the recording medium cassette 5 is removed, a problem such as the paper sheet P being stuck in the transportation path can be easily solved. Although not shown in the figure, the recording medium cassette 5 is slidable in the Z axis direction with respect to the housing 2 and a mounting and/or removing operation of the recording medium cassette 5 is carried out by sliding the recording medium cassette 5.

The recording medium cassette 5 includes a cassette body 51 that stores the paper sheets P in the vertical position and an output holding unit 52 that is formed in the cassette body 51 and holds the paper sheets P in the vertical position.

The cassette body 51 includes a cassette housing section 53 that is, when mounted, flush with the housing 2 and constitutes the outline of the recording apparatus 1, a body tray 54 that is generally formed in a tray shape, an upper outer cover 55 that openably covers a paper sheet storing space S in which the paper sheets P are stored, an upper inner cover 56 that is slidably movable relative to the upper outer cover 55 so as to extend from the upper end of the body tray 54, an upper slide tray 57 that is slidably movable relative to the body tray 54 so as to extend from the upper end of the body tray 54, an edge guide 58 that is slidably movable in the X axis direction relative to the upper outer cover 55, and a movable tray 59 that swings the leading end of the paper sheets P stored in the paper sheet storing space S.

A paper sheet leading end support wall 54*a* is formed at the lower end of the body tray 54 so as to support the leading end of the stored paper sheets P. The paper sheets P stored in the recording medium cassette 5 which is in a mounted state are supported by the paper sheet leading end support wall 54*a* with the leading end being in contact with the paper sheet leading end support wall 54*a*.

Figure 5:
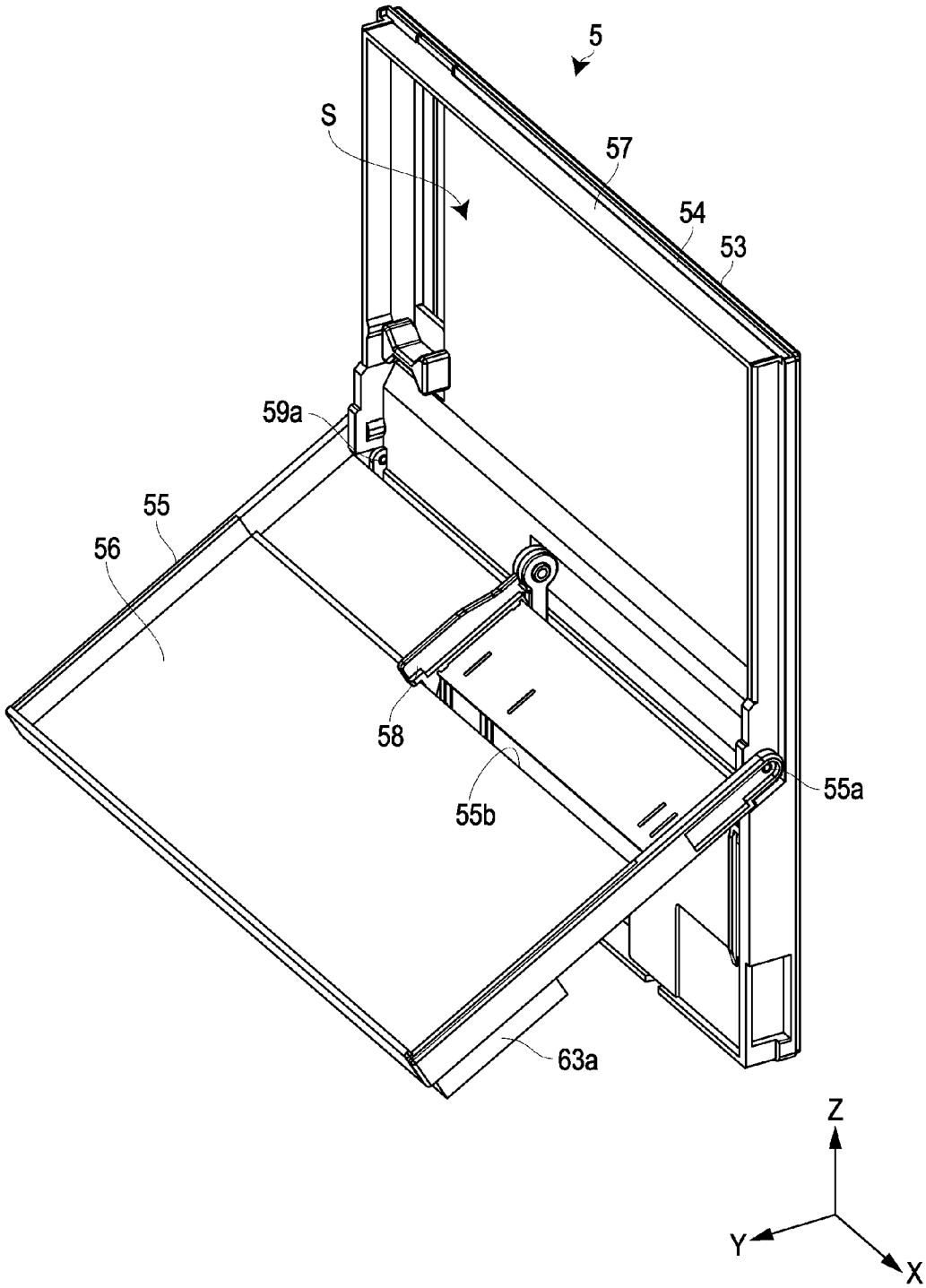
FIG. 5 is a perspective view of the recording medium cassette according to the first embodiment of the invention with an upper external cover being opened.

As shown in FIG. 5, the upper outer cover 55 is rotatable about a pair of pivot points 55*a*, each of which is formed at a substantially center position in the up-down direction on the left and right sides of the body tray 54. When the upper outer cover 55 is opened, the paper sheet storing space S is exposed so that the paper sheets P can be stored therein.

The outer surface of the upper outer cover 55, that is, a surface that faces inside the apparatus when the upper outer cover 55 is mounted on the housing 2 serves as a holding surface 61 that holds (stocks) the paper sheet P after recording being performed (the details will be described later).

As shown in FIGS. 2 and 3, the upper inner cover 56 is slidably movable in a feeding direction of the paper sheet P (Z axis direction) relative to the upper outer cover 55 in the state where the recording medium cassette 5 is mounted on the recording apparatus 1 (the housing 2). Similarly, the upper slide tray 57 is slidably movable in Z axis direction relative to the body tray 54 in the state where the recording medium cassette 5 is mounted. The upper inner cover 56 and the upper slide tray 57 are expanded and/or collapsed to be adjusted for the length of the paper sheet P in the Z axis direction, thereby forming a paper sheet storing space S that is optimal for the paper sheet P.

When the upper inner cover 56 is expanded, the outer surface of the upper inner cover 56 extends continuously from the upper outer cover 55 such that the holding surface 61 is extended in the Z axis direction.

Figure 4:
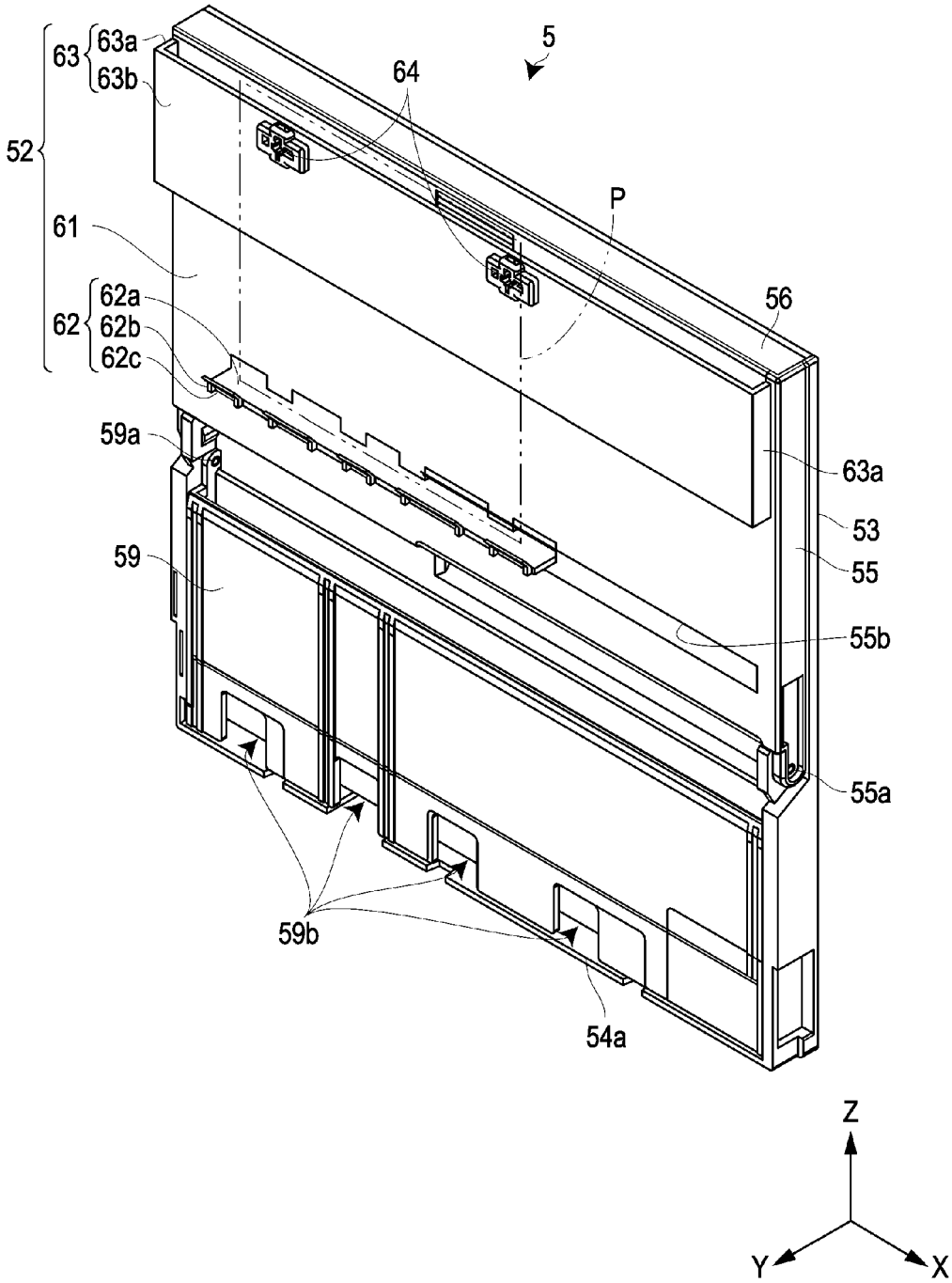
FIG. 4 is a perspective view of a recording medium cassette according to a first embodiment of the invention.

As shown in FIGS. 4 and 5, the edge guide 58 slidably engages with an elongated hole 55*b* opened on the upper outer cover 55 in the X axis direction and is slidably movable to be adjusted for the width of the paper sheet P stored in the paper sheet storing space S. Accordingly, the edge of the paper sheet P that has been set is guided at an appropriate position according to the length (width) of the paper sheet P in the X axis direction. Although not shown in the figure, a portion of the edge guide 58 is exposed to the outside of the upper outer cover 55, so that the edge guide 58 can be slide by operating the exposed portion when the upper outer cover 55 is closed.

As shown in FIGS. 2 and 3, the movable tray 59 is disposed on the lower side of the body tray 54 which is the downstream region in the feeding direction of the paper sheet P in the state where the recording medium cassette 5 is mounted and serves as a so-called hopper. The movable tray 59 is rotatable about a pair of pivot points 59*a*, each of which is formed at a substantially center position in the up-down direction on the left and right sides of the body tray 54 (see FIGS. 4 and 5) and pivotally moves by a drive mechanism, which is not shown in the figure. Accordingly, the leading end of the stored paper sheet P can be moved between a state where it is in pressing contact with the feeding roller 41 (see FIG. 3) and a state where it is away from the feeding roller 41 (see FIG. 2).

Further, as shown in FIG. 4, a plurality of contact openings 59*b* are formed on the movable tray 59 at positions that correspond to the leading end of the paper sheet P and are spaced apart from each other at appropriate distances along the X axis direction. The plurality of contact openings 59*b* enables the feeding roller 41 to come pressing contact with the stored paper sheet P.

Next, referring to FIGS. 2 through 4, the output holding unit 52 will be described below. the output holding unit 52 includes the holding surface 61 that is composed of the outer surface of the upper outer cover 55 and the like, a receiving section 62 that receives the lower end of the output paper sheet P and regulates the position of the lower end of the received paper sheet P so as not to be in contact with the paper output rollers 44, and a holder 63 that is disposed on the holding surface 61 and holds the paper sheet P in the vertical position.

The holding surface 61 is a substantially flat surface that extends from the vicinity of the pair of paper output rollers 44 to the paper sheet output port 24 when the recording medium cassette 5 is mounted on the housing 2. As described above, when the upper inner cover 56 is expanded, the holding surface 61 is extended to the upper position beyond the paper sheet output port 24. The paper sheet P is output by the paper output rollers 44 and is moved toward a paper sheet output port 24 while being in slidable contact with the holding surface 61. The paper sheet P is output extending from the paper sheet output port 24 depending on the size of the paper sheet P.

As mentioned above, the paper sheet storing space S in which unrecorded paper sheets P are stored and the holding surface 61 in which recorded paper sheets P are held are formed on the front and back sides of the same member (upper outer cover 55 and the upper inner cover 56). Accordingly, when adjustment for the size of the paper sheet P is carried out on the paper supplying side, adjustment for the size of the paper sheet P on the paper output side can be achieved at the same time. Since a portion (a side) of the upper outer cover 55 (and the upper inner cover 56) serves as the holding surface 61 that supports the paper sheet P, a separate configuration to hold the paper sheet P can be eliminated, thereby simplifying the configuration and reducing the cost.

The receiving section 62 includes a support section 62*a* that extends from the holding surface 61 toward the paper output rollers 44 and supports the lower end of the paper sheet P and a regulation section 62*b* that is formed at the distal end of the support section 62*a* so as to extend upward and regulates the position of the lower end of the received paper sheet P. That is, the receiving section 62 is formed in an L-shape in a side view. In addition, a plurality of regulation sections 62*b* are arranged spaced apart from each other at appropriate distances in the X axis direction so as to be interposed between each of a plurality of drive rollers of the paper output rollers 44 that are arranged spaced apart from each other at appropriate distances (see FIG. 4). That is, the regulation section 62*b* is generally formed as a substantially comb shape.

As shown in FIG. 2, the inner surface of the regulation sections 62*b* (a surface faces the holding surface 61) is located between the drive roller of the paper output rollers 44 and the holding surface 61 and is located at the vicinity of the roller 44 and a position lower than the rotation shaft of the roller 44. A medium introduction section 62*c* is formed at the upper end of the respective regulation section 62*b* so as to bend toward the paper output rollers 44. This allows the lower end of the paper sheet P that has been fed over the top of the drive roller of the paper output rollers 44 to be appropriately and smoothly introduced into the receiving section 62.

The paper sheet P that has been fed from the pair of paper output rollers 44 is output toward the holding surface 61 which is the outer surface of the cassette body 51 between the holder 63 and the receiving section 62, and the lower end of the paper sheet P is received in the receiving section 62 generally in the vertical position. The position of the lower end of the received paper sheet P is regulated by the regulation section 62*b* so as not to be in contact with the drive roller of the paper output rollers 44.

As shown in FIGS. 2 through 4, the holder 63 has a pair of pillars 63*a*, each of which extends from either end of the upper outer cover 55 in the X axis direction and a plate-shaped body 63*b* that extends between the pair of pillars 63*a*.

The plate-shaped body 63*b* faces the holding surface 61 with a gap interposed therebetween and is formed to transverse the paper sheet P in the X axis direction. That is, the plate-shaped body 63*b* is away from the holding surface 61 by a distance of the length of the pair of pillars 63*a* in the Y axis direction. The gap between the plate-shaped body 63*b* and the holding surface 61 may have a distance appropriately determined depending on the thickness or the number of sheets of the paper sheet P to be held, and desirably has a distance substantially same as that of the paper sheet storing space S on the supplying side of the paper sheet P.

A pair of curl correction rollers 64 are rotatably provided on the left and right sides on the upper side of the plate-shaped body 63*b*. Each curl correction roller 64 is formed as a spur-shaped roller (star wheel) and biased toward the holding surface 61.

The paper sheet P that has been output from the paper output rollers 44 moves toward the paper sheet output port 24 while being in slidable contact with the holding surface 61 and held by the holder 63 while being kept in the vertical position. Further, the paper sheet P that has been output is held in the vertical position between the holder 63 and the holding surface 61 after a curled sheet (curled state) is corrected by the respective curl correction roller 64. This makes it possible that the paper sheets P are sequentially stacked on the holding surface 61 without leaning in an appropriate manner, and then the paper sheets P can be continuously output. It is also possible to prevent the damage of the paper sheet P that may occur when the recording medium cassette 5 is removed with the recorded paper sheet P leaning. Further, since the recorded paper sheet P can be supported on an area having long length in the width direction (X axis direction), the recorded paper sheet P can be held with certainty without being damaged.

According to the above configuration, when the recording medium cassette 5 is removed from the recording apparatus 1, supplying of unrecorded paper sheet P and removing of recorded paper sheet P can be achieved at the same time. This facilitates removing of recorded paper sheet P, even if the paper sheet P is small and removing of recorded paper sheet P with the recording medium cassette 5 being mounted on the recording apparatus 1 is difficult. Although the recording medium cassette 5 is applied to a so-called vertical type recording apparatus 1 in this embodiment, the recording apparatus 1 of horizontal type may be used as a matter of course. In this case, it is desirable that the recording apparatus 1 is installed with the cassette housing section 53 being the bottom.

Second Embodiment

Figure 6:
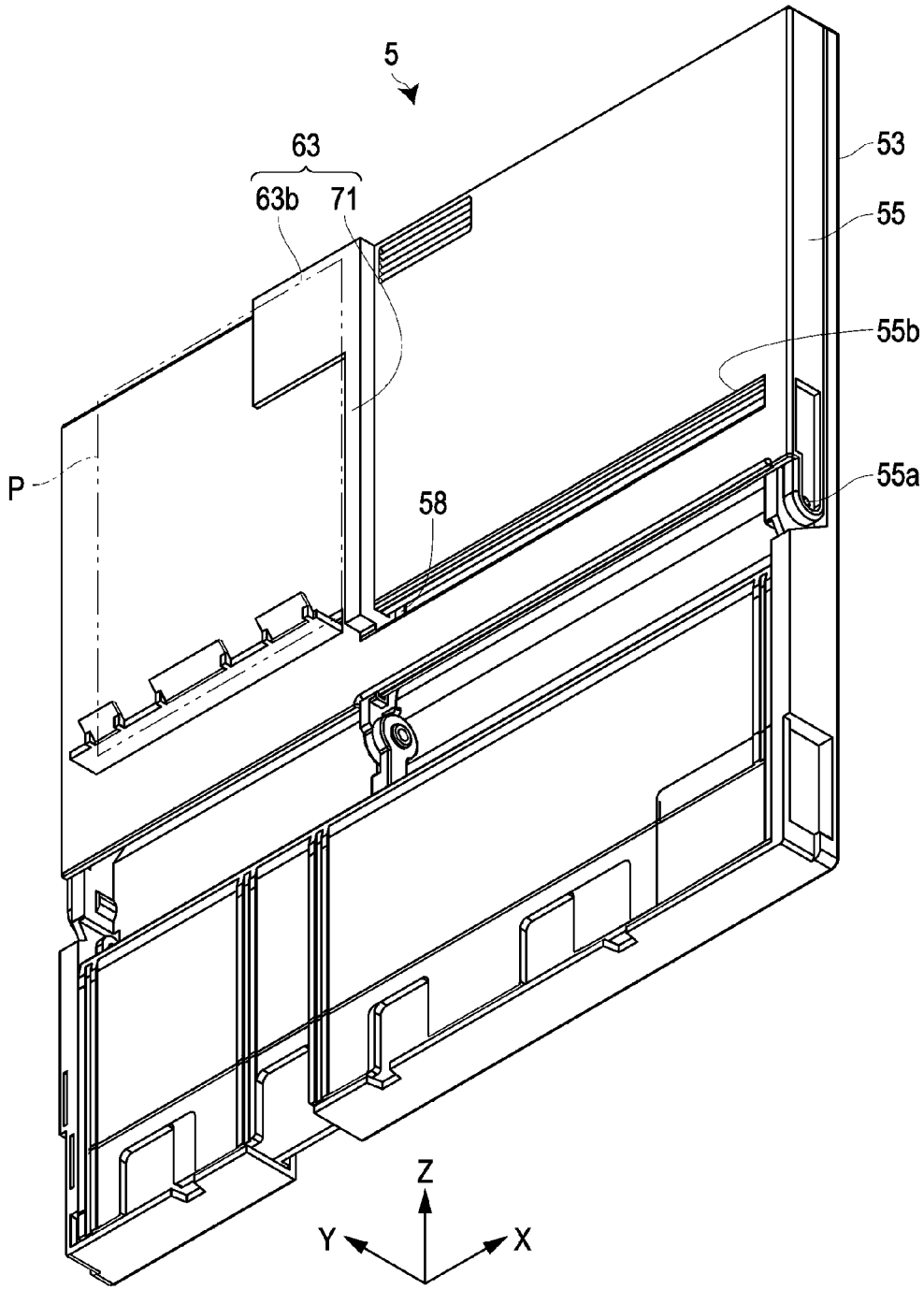
FIG. 6 is a perspective view of a recording medium cassette according to a second embodiment of the invention.

Next, referring to FIG. 6, a recording medium cassette 5 according to a second embodiment of the invention will be described. In the following description, description will be made only for those different from the first embodiment. The recording medium cassette 5 according to the second embodiment is configured such that a plate-shaped body 63*b* of a holder 63 faces the output paper sheet P at one end (the right end in FIG. 6) in the X axis direction of the paper sheet P. Further, the holder 63 also serves as a side alignment guide for the recorded paper sheet P.

Specifically, the holder 63 includes a guide bar 71 that is connected to a portion of an edge guide 58 which is exposed from an elongated hole 55*b* with which the edge guide 58 slidably engages, and a plate-shaped body 63*b* that is connected at the upper end of the guide bar 71. That is, the edge guide 58 and the holder 63 are disposed on either side of the upper outer cover 55. Therefore, adjustment for guiding the edge of the paper sheet P can be easily performed by operating the edge guide 58 or the holder 63.

With this configuration, the recorded paper sheet P can be held on a small contact area. This reduces the possibility of damage on the recording surface of the paper sheet P due to contact between the plate-shaped body 63*b* and the recording surface.

Third Embodiment

Figure 7:
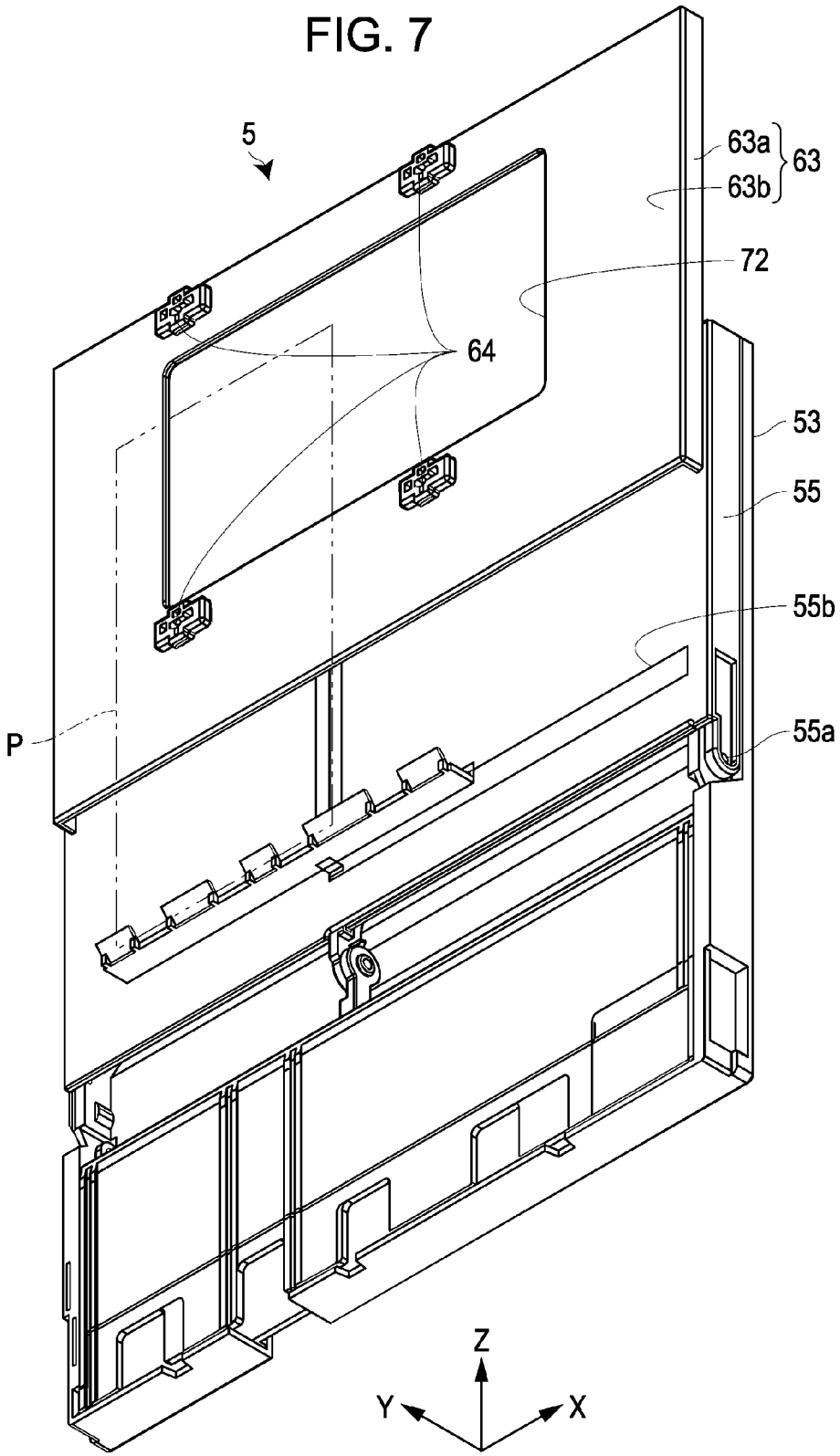
FIG. 7 is a perspective view of a recording medium cassette according to a third embodiment of the invention.

Next, referring to FIG. 7, a recording medium cassette 5 according to a third embodiment of the invention will be described. In the following description, description will be made only for those different from the first embodiment. The recording medium cassette 5 according to the third embodiment is configured, when mounted on the housing 2, such that a holder 63 extends upward from the top of a cassette housing section 53 (a body tray 54). With this configuration, since the holder 63 extends in the feeding direction of the paper sheet P, the paper sheet P can be appropriately held in the vertical position, even if the paper sheet P has a longer length in the feeding direction.

Further, an opening 72 is formed on the holder 63 (more specifically, the plate-shaped body 63*b*) that extends from the top of the cassette housing section 53 when mounted on the housing 2 such that the paper sheet P held on the holding surface 61 can be viewed through the opening 72 from the outside. This enables to confirm the output paper sheet P from the outside and prevent the paper sheet P from being left.

In addition, four curl correction rollers 64 are disposed on the upper, lower, left and right sides of the opening 72, such that a curled sheet can be appropriately corrected, even if the paper sheet P has a longer length in the feeding direction.

The entire disclosure of Japanese Patent Application No. 2011-17946, filed Jan. 31, 2011 is expressly incorporated by reference herein.

What is claimed is:

1. A recording apparatus comprising:
- a recording section that performs recording on a recording medium;
- a housing that stores the recording section;
- a recording medium cassette that is detachably mounted on the housing and has a cassette body that holds the recording medium in the vertical position; and
- a holder that holds the recording medium that has been fed from the cassette body and has been recorded in the recording section on an outer surface of the cassette body in the vertical position;
- wherein the outer surface of the cassette body has a receiving section that receives the lower end recording medium that has been recorded in the recording section.

2. The recording apparatus according to claim 1, further comprising a paper output roller that outputs the recording medium toward the outer surface of the cassette body between the holder and the receiving section.

3. The recording apparatus according to claim 1, wherein the holder extends from the cassette body in the feeding direction of the recording medium.

4. A recording apparatus comprising:
- a recording section that performs recording on a recording medium;
- a housing that stores the recording section;
- a recording medium cassette that is detachably mounted on the housing and has a cassette body that holds the recording medium in the vertical position; and
- a holder that holds the recording medium that has been fed from the cassette body and has been recorded in the recording section on an outer surface of the cassette body in the vertical position;
- wherein the holder has a plate member that faces the outer surface with a gap interposed therebetween,
- wherein the holder serves as a side alignment guide for the recording medium that has been output, and
- wherein the holder is formed integral with an edge guide that guides the edge of the recording medium stored in the cassette body.

5. The recording apparatus according to claim 4, wherein the holder has an opening through which the recording medium held by the holder is viewable from the outside.

6. A recording apparatus comprising:
- a housing;
- a recording medium cassette that is detachably mounted on the housing and stores a recording medium in the vertical position;
- a recording section that is arranged in the housing and performs recording on the recording medium that has been fed from the recording medium cassette; and
- a holding portion that is arranged to a side of the recording medium cassette in the vertical position and holds the recording medium that has been recorded in the recording section.

7. The recording apparatus according to claim 6, wherein the holding portion is arranged vertically from a middle section of the recording medium cassette upward.

* * * * *